US005821675A

United States Patent [19]

Suzuki

[11] Patent Number: 5,821,675

[45] Date of Patent: Oct. 13, 1998

[54] SPARK PLUG FOR AN INTERNAL COMBUSTION ENGINE AND A METHOD OF MAKING THE SAME

[75] Inventor: Takahiro Suzuki, Nagoya, Japan

[73] Assignee: NGK Spark Plug Co., Ltd., Nagoya, Japan

[21] Appl. No.: 657,909

[22] Filed: Jun. 7, 1996

[30] Foreign Application Priority Data

Jun. 8, 1995 [JP] Japan ..... 7-166849
Jun. 5, 1996 [JP] Japan ..... 8-142478

[51] Int. Cl.[6] ..... H01T 13/46

[52] U.S. Cl. ..... 313/123; 313/139; 313/140; 313/141

[58] Field of Search ..... 313/123, 139, 313/140, 141, 142

[56] References Cited

U.S. PATENT DOCUMENTS 1,270,437 11/1918 Reppin ..... 313/123
1,353,593 9/1920 Jorgenson .
1,359,358 3/1920 Bartha et al. ..... 313/123
1,461,405 7/1923 Solomon ..... 313/123
1,621,581 10/1927 Clark ..... 313/123
2,129,576 9/1938 Gorny et al. ..... 313/123
4,272,697 6/1981 Wax ..... 313/123
4,973,877 11/1990 Suzuki et al. ..... 313/131 A

FOREIGN PATENT DOCUMENTS 4331269 3/1995 Germany ..... H01T 21/02

*Primary Examiner*—Vip Patel

[57] ABSTRACT

In a spark plug, a metal shell has first and second open ends. A ground electrode is formed in integral with the metal shell, provided on the first open end of the metal shell. An insulator has an axial bore, held in the metal shell. A center electrode in the bore of the insulator has a front end extending beyond the insulator. At least one row of intermediary electrode strips is arranged intermittently in a circumferential direction around an end portion of the insulator so as to form a series of spark discharge gaps circumferentially around the end portion of the insulator, and disposed between the ground electrode and the end portion of the center electrode.

19 Claims, 9 Drawing Sheets

SPARK PLUG FOR AN INTERNAL COMBUSTION ENGINE AND A METHOD OF MAKING THE SAME

BACKGROUND OF THE INVENTION

1. Field of the Invention

This invention relates to a spark plug which is mounted on a cylinder head of an automotive internal combustion engine to ignite an air-fuel mixture.

2. Description of Prior Art

A spark plug for use in an internal combustion engine is generally shown in FIG. 9, wherein a center electrode 30 is provided through a bore of an insulator 20 mounted in a passage of a metal shell 60. The metal shell 60 of the spark plug 1 is to be secured to a cylinder head of an internal combustion engine (not shown) by way of a male thread 90 provided with an outer surface of the metal shell 60. The center electrode 30 has one end connected to a terminal 50 for electrical input, and having the other end extended beyond the front end of the insulator 20 to form a spark gap 130 with a L-shaped ground electrode 70 extended from the threaded end portion 90.

When a high voltage is supplied to the terminal 50 a spark discharge occurs along the spark gap 130 across the center electrode 30 and the ground electrode 70 so as to ignite an air-fuel mixture injected into a combustion chamber of the internal combustion engine.

However, in this spark plug 1, an orientation of the ground electrode 70 placed in the combustion chamber changes owing to the variance of an initial tap of the male thread 90 even in the same type of the spark plug when the metal shell 60 is screwed into the cylinder head.

On the other hand, the injected air-fuel mixture swirls in the combustion chamber during a stroke of compression before the ignition. Depending on the orientation, the ground electrode 70 occasionally happens to block or to prevent the swirls of the air-fuel mixture from being ignited. This leads to a bad ignitability resulting in an unstable combustion and an insufficient power-output of the engine. Particularly in the cold season, the nascent flames are prevented from fully growing in the combustion chamber. This is because the flames are quickly cooled in running, further by the end portion of the insulator 20, the firing ends of the center electrode 30 and the ground electrode 70 which are not sufficiently heated yet during a start-up or idle operation of the engine.

With the single spark gap provided in the spark plug explained above, the ignition often causes a misfire in which the spark discharge fails to fire the air-fuel mixture or the nascent flames disappears without sufficiently spreading even if the spark discharge have made the air-fuel mixture ignited under unfavorable conditions as using an air-rich fuel or intaking a back flow of the exhaust gas.

In order to lessen these inconveniences, some instructive suggestions or teachings are disclosed in Japanese Laid-Open Patent Application No. 61-296675 and Japanese Utility Model Resistration No. 59-3507.

The former publication No. 61-296675 discloses a multi-spark system in which a ceramic material is used for an inner wall of the combustion chamber near an upper end of a cylinder block or a lower end of a cylinder head. To the inner wall made of the ceramic material, a plurality of Ni-based electrodes are soldered to provide multi-spark gaps along the inner wall of the combustion chamber.

With the use of the multi-spark system, it is possible for the spark discharges to smoothly ignite the air-fuel mixture because all the ground electrodes do not hide the swirls at once. However, it is difficult to install or replace the spark plugs without manufacturing a new engine and, the ground electrodes tend to unacceptably erode with an extended use of the spark plug. This makes it unrealistic to put into a practical use in the industrial circle.

The latter publication of No. 59-3507 discloses a spark plug in which a center electrode extends beyond a front end of a metal shell to provide an insulator coated around an elevational surface of an extended leg of the center electrode. Between a front distal end of the center electrode and a ground electrode depending from the metal shell, some intermediary annular electrodes are provided and from which a plurality of projections are extended in a longitudinal direction.

In this spark plug, spark discharges occur between the center electrode and the ground electrode via the projections to smoothly ignite the air-fuel mixture because it does not have a L-shaped ground electrode which hinders the swirls of air-fuel mixture in the internal combustion engine. However, the intermediary annular electrodes are accumulated in a longitudinal direction, each spaced on the insulator for spark discharge in the longitudinal direction so as to exceedingly lengthen the extended end of the insulator, thus exposing its extended end to a high heat environment in the combustion chamber. The heated end of the insulator sets the air-fuel mixture on fire spontaneously to render it unable to precisely control an ignition timing particularly when running the engine at higher speed of revolution. This may cause to further heat the extended end of the insulator to prematurely fire the air-fuel mixture so as to thermally melt the insulator and the center electrode.

In order to shorten the extended length of the insulator, so as to avoid a heavy exposure to the extreme heat, there is hardly any choice but to reduce a width of the intermediary annular electrode, thus posing a problem on considering a spark erosion resistant property thereof.

Therefore, it is one of the objects of the invention to provide a multi-gap type spark plug for an internal combustion engine, which is spark-erosion resistant and capable of uniformly igniting an air-fuel mixture irrespective of which direction the spark plug is oriented. This invention is achieved by that a row of intermediary electrode strips are arranged intermittently and circumferentially around the insulator to form a plurality of spark gaps circumferentially around the insulator.

SUMMARY OF THE INVENTION

According to the present invention there is provided a cylindrical metal shell having first and second open ends; a ground electrode provided on the first open end of the metal shell; an insulator having an axial bore in which a center electrode is coaxially placed whose front end slightly extended beyond the insulator; and at least one intermediary electrode strips arranged circumferentially around an end portion of the insulator so as to form a series of spark discharge gaps annularly or circumferentially around the end portion between the ground electrode and the center electrode. Serial sparks occur in a circumferential sequence around the insulator end, saving a longitudinal space according to the present invention.

Further to the present invention, a row of intermediary electrode strips is arranged intermittently and circumferentially around a stepped portion of the end portion of the insulator in a manner of staggers therealong.

According to another aspect of the present invention, a first auxiliary electrode strip is provided on the elevational side of the front end portion of the insulator to be located between the center electrode and the intermediary electrode strips.

According to another aspect of the present invention, a second auxiliary electrode strip is provided on the elevational side of the front end portion of the insulator to be located between the ground electrode and the intermediary electrode strips.

According to another aspect of the present invention, the intermediary electrode strip is made of platinum or tungsten.

According to another aspect of the present invention, the intermediary electrode strip is made of alumina-based ceramic material with an addition of platinum or tungsten.

According to another aspect of the present invention, at least one of the first and second auxiliary electrode strips is made of platinum-based or tungsten-based alloy.

According to another aspect of the present invention, at least one of the first and second auxiliary electrode strips is made of alumina-based ceramic material with platinum or tungsten as a main ingredient.

According to another aspect of the present invention, each end of the intermediary electrode strips has a width-increased end facing each other with the respective spark discharge gap interposed therebetween.

According to another aspect of the present invention, the front end portion of the insulator has a stepped portion to which the intermediary electrode strips, the first and second auxiliary electrode strips are adhered.

According another aspect of the present invention, there is provided a method of making a spark plug comprising steps of: placing an insulator within a cylindrical metal shell so that a front end of the insulator extends somewhat beyond a front end of the metal shell; arranging intermediary electrode strips intermittently on a sheet of adhesive paper; providing an acrylic, cellulose or alumina based top coat on each of the intermediary electrode strips; separating the intermediary electrode strips from the sheet of the adhesive paper so as to stick the intermediary electrode strips circumferentially around a front end portion of the insulator; and sintering the intermediary electrode strips at approximately 1600° C. concurrently with the insulator so as to integrate the intermediary electrode strips with the insulator.

According to another aspect of the present invention, there is provided the method including a step providing an auxiliary electrode strip between the center electrode and the intermediary electrode strip.

According to another aspect of the present invention, there is provided the method further including a step providing a second auxiliary electrode strip between the last intermediary electrode strip and the ground electrode.

According to the invention with the spark discharge gaps provided serially between the center electrode, and the ground electrode, via the auxiliary ring electrode strips provided by intermittently and circumferentially placing the intermediary electrode strips around the leg portion of the insulator, it is possible to positively ignite the swirls of the air-fuel mixture regardless of which direction the spark plug is oriented in the combustion chamber. With the spark discharge occurring omnidirectionally, it is further possible to fully burn out the carbon deposit to be piled on an outer surface of the leg portion of the insulator when the leg portion is smoldered due to repeated ignitions, according to the invention.

BRIEF DESCRIPTION OF THE DRAWINGS

These and other objects, aspect and embodiments of the invention will be described in more detail with reference to the following drawing figures, of which.

DETAILED DESCRIPTION OF PREFERRED EMBODIMENTS OF THE INVENTION

Figure 1:
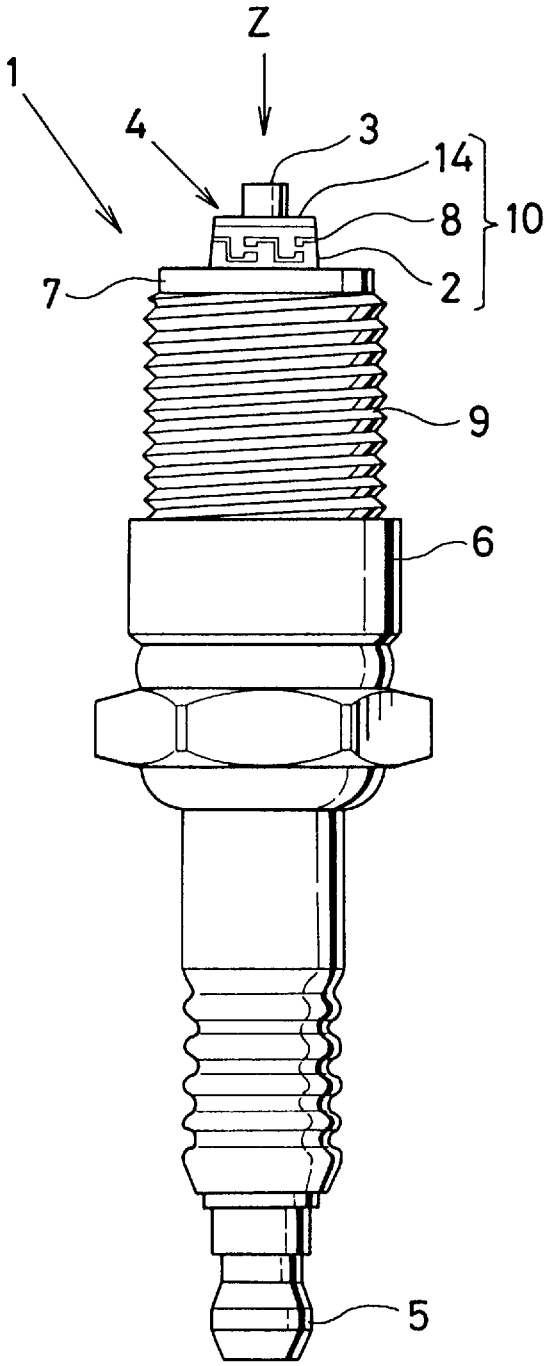
FIG. 1 is a plan view of a spark plug according to an embodiment of the present invention.

Referring to FIG. 1 which shows a spark plug 1 according to a first embodiment of the invention. The spark plug 1 has a row of intermediary electrode strips 8, provided serially and circumferentially on the leg portion of the insulator 2, and a center electrode 3 provided in the bore of the insulator 2 extended forward. At a rear end of the spark plug 1, a terminal electrode 5 is secured to the other end of the center electrode 3 which is placed in an axial bore 4 of a tubular insulator 2 which is located in a metal shell 6. An outer surface of the metal shell 6 has a male thread 9 with which the spark plug is screwed into a plug hole provided with a cylinder head of an internal combustion engine.

As shown in FIG. 1, a leg portion 10 of the insulator 2 extends beyond a front end of the metal shell 6 with a front of the center electrode 3 somewhat extended beyond the leg portion 10 so as to expose a row of intermediary electrode strips 8 and an auxiliary annular electrode strip 14. These electrode strips are made for instance of a paste metal prepared by baking a mixture of platinum, tungsten and alumina powders with an addition of acrylic or cellulose based binder. When the tungsten is used as a powder metal, the mixture is treated in a deoxidization atmosphere.

Figure 2:
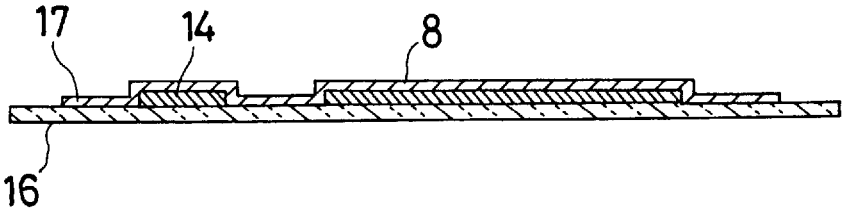
FIG. 2 is enlarged cross sectional view of intermediary electrode strips and auxiliary electrode strips.

Upon baking these electrode strips of the paste metal, the row of the intermediary electrode strips 8 and the auxiliary electrode strip 14 are printed on a sheet of paper 16 to which a water-soluble adhesive is applied as shown in FIG. 2. Then a layer of top coat 17 is applied to an outer surface of the intermediary electrode strips 8 and the auxiliary electrode strip 14. The intermediary electrode strips 8 and the auxiliary electrode strip 14 shown in FIG. 2, are adhered around an elevational surface of the leg portion 10 of the insulator 2 of FIG. 1, while separating these electrode strips from the sheet of paper 16. The intermediary electrode strips 8 and the auxiliary electrode strip 14 are integrally sintered concurrently with the leg portion 10 of the insulator 2 at the temperature of approximately 1600° C. In this instance, it is to be observed that the alumina-based top coat 17 has substantially no affect on a spark discharge action across the electrodes as long as sufficiently thinning the top coat layer since the top coat 17 is integrally metallized with strips 8 after concurrently sintering the insulator 2 with the top coat 17.

Figure 3:
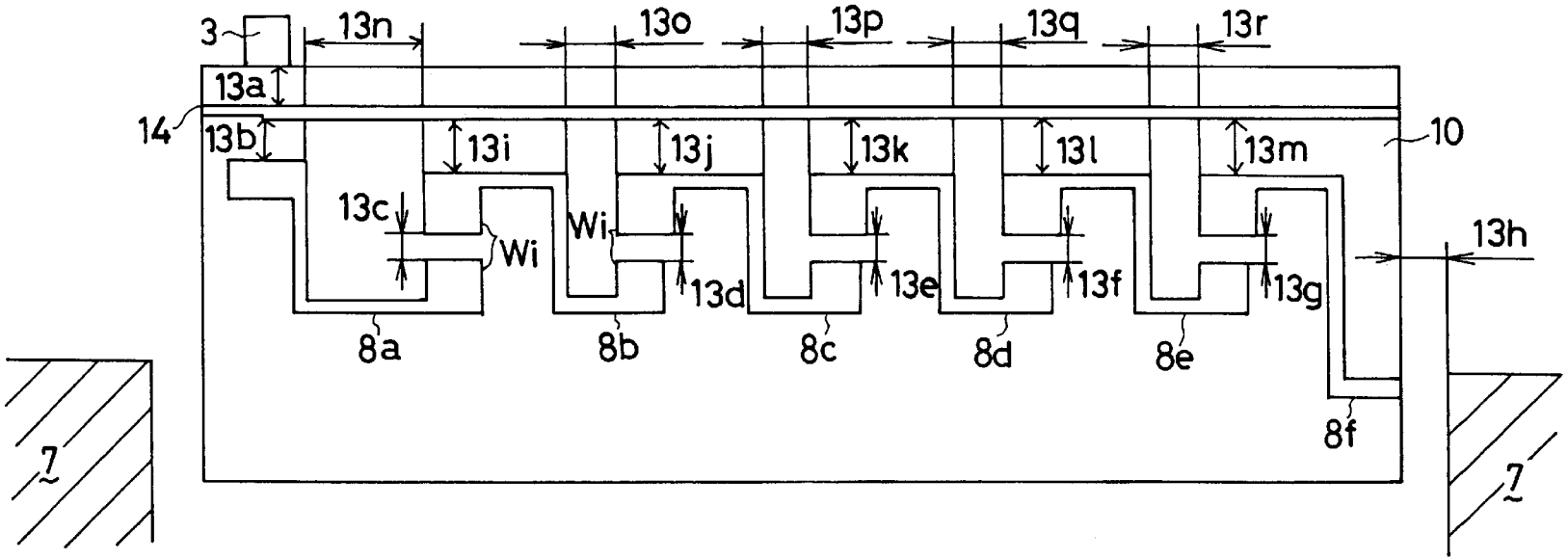
FIG. 3 is a development view of a leg portion of an insulator.

As shown in FIG. 3 which is a development view of the leg portion 10, the auxiliary electrode strip 14 encircles around a front distal end of the leg portion 10. The row of the intermediary electrode strips 8 is formed into a sigmoidal section discontinuously arranged in a staggered manner in a circumferential direction of the leg portion 10. Between the front end of the center electrode 3 and the auxiliary electrode strip 14, a spark gap 13*a* is provided. A spark gap 13*b* is defined between the auxiliary electrode strip 14 and a first intermediary electrode strip 8*a*. Spark gaps are provided respectively between the neighboring ends of the first–sixth intermediary electrode strips 8*a*–8*f*, as designated by numerals 13*c*–13*g*.

Between the auxiliary electrode strip 14 and the second–sixth intermediary electrode strips 8*b*–8*f*, spark gaps are defined respectively as designated by numerals 13*i*–13*m*. The spark gaps 13*b*–13*g* generally have the same width, and the spark gaps 13*i*–13*m* generally have the same width. The spark gap 13*b* is smaller than the spark gap 13*i*. Numeral 13*n* designates a nearest distance of the first intermediary electrode strip 8*a* from the second intermediary electrode 8*b* except the spark gap 13*c*. Numeral 130 designates an effective distance of the second intermediary electrode strip 8*b* from the third one 8*c* except the spark gap 13*d*. Numeral 13*p* designates a minimum distance of the third intermediary electrode strip 8*c* from the fourth one 8*d* except the spark gap 13*e*. Numeral 13*q* designates a nearest distance of the fourth intermediary electrode strip 8*d* from the fifth one 8*e* except the spark gap 13*f*. Numeral 13*r* designates an minimum distance of the fifth intermediary electrode strip 8*e* from the sixth one 8*f* except the spark gap 13*g*. The spark gap 13*b* is smaller than each of the gaps 13*n*–13*r*. The neighboring ends of the first–sixth intermediary electrode strips 8*a*–8*f*, have such width-increased distals as designated by denotation Wi, as enough to resist the spark erosion.

When the high voltage is supplied to the center electrode 3 from an ignition coil, a spark discharge occurs along the spark gap 13*a* between the center electrode 3 and the auxiliary electrode strip 14. Then, the electrified electrode strip 14 causes a spark discharge toward the first intermediary electrode strip 8*a*, and thereby in sequence causing a spark discharge along the spark gaps 13*c*–13*g* madeby the first–sixth intermediary electrode strips 8*a*–8*f*, and to a ground electrode 7 integral with the metal shell 6 along the spark gap 13*h* in rapid succession. The dimensional arrangement is that the spark gap 13*b* is smaller than the spark gap 13*i*, and the spark gap 13*b* is smaller than any of the spark gap 13*n*–13*r* in order to initiate the spark discharge along the spark gap 13*b* made between the auxiliary electrode strip 14 and the first intermediary electrode strip 8*a*, followed by a circumferential sequence of spark discharge via the rest of spark gaps 13*c*–13*h*.

The auxiliary electrode strip 14 effectively works particularly when the center electrode 3 is in an eccentric relation with the axial bore 4. With the accumulated dimensional variance of the insulator 2, the axial bore 4, the center electrode 3 or the like, it may be unavoidable to have the eccentricity of the center electrode 3 after assembling the spark plug 1.

Figure 4:
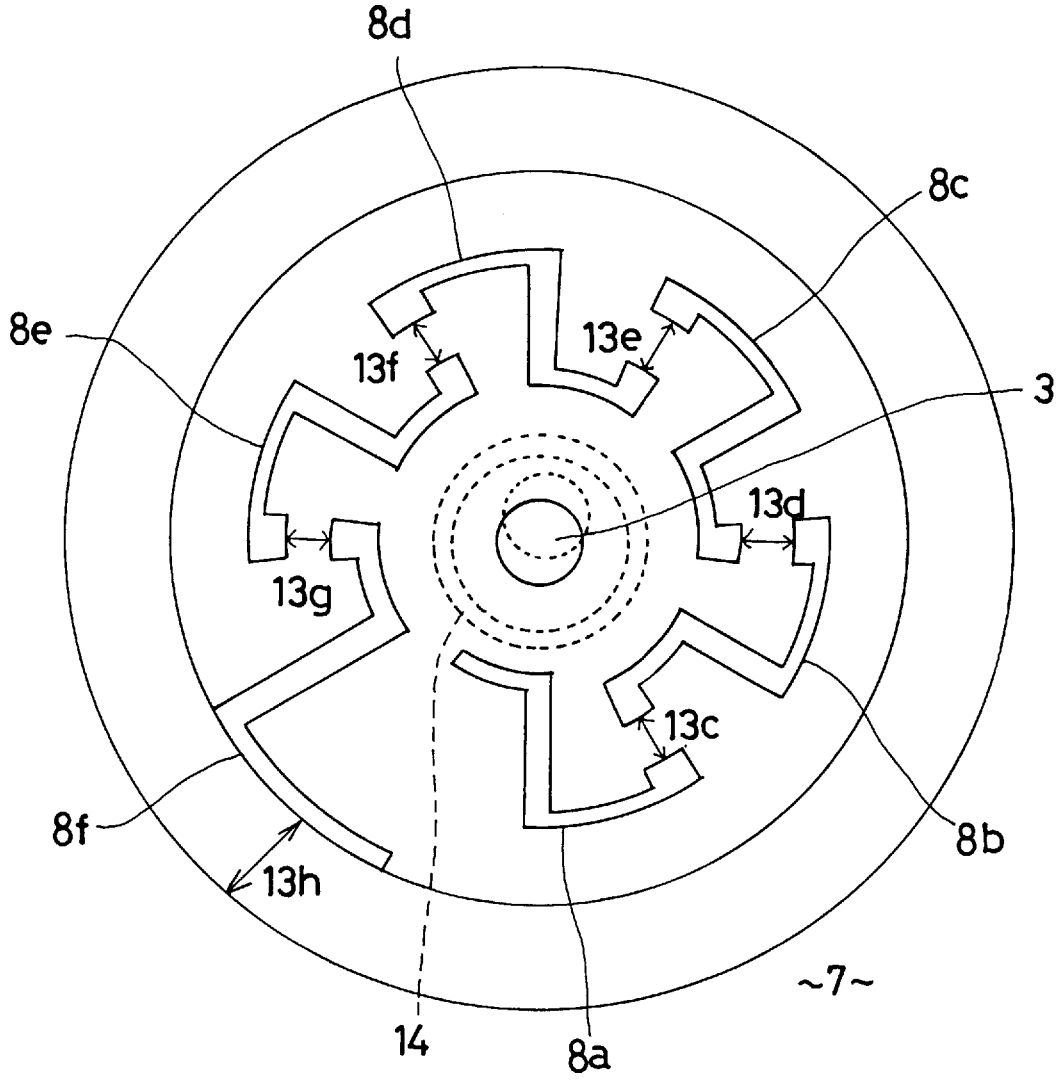
FIG. 4 is an enlarged development view of a firing end of the spark plug viewed from an arrow Z of FIG. 1.

The eccentricity of the center electrode 3 changes the distance of the first intermediary electrode strip nearest to the center electrode 3 due to product variance. An absence of the eccentricity of the center electrode 3 positions the first intermediary electrode strip 8*a* nearest to the center electrode 3 as shown by the solid line in FIG. 4. The center electrode 3 comes near the intermediary electrode strip in its eccentric direction. When the center electrode 3 displaces as shown by the broken lines in FIG. 4, the center electrode 3 is closer to the fourth intermediary electrode strip 8*d*. In this instance, this displacement of the center electrode 3 allows the spark discharge to occur along the spark gaps 13*f*, 13*g*, 13*h* with no spark discharge running along the spark gaps 13*c* –13*e*. This means a failure of equally growing the spark discharge in the circumferential direction around the leg portion 10 of the insulator 2. With the presence of the annular electrode strip 14, it is possible to firstly grow the spark discharge inevitably between the center electrode 3 and the auxiliary electrode strip 14 regardless of which direction the center electrode 3 is eccentrically displaced away from the center of the axial bore 4. This annular electrode strip makes the spark discharges grow along the spark gaps 13*a*–13*h* equally in succession in the circumferential direction of the leg portion 10 of the insulator 2.

In a preferable embodiment of the method of the invention, with the intermediary electrode strip 8 and the auxiliary electrode strip 14 pre-printed on the sheet of paper 16 integrally with the alumina-based top coat 17 by means of the metal paste, refering back to FIG. 2, it is suggested to adhere the electrode strips 8, 14 tightly to the elevational surface of the leg portion 10 while separating the electrode strips 8, 14 from the sheet of paper 16. Since these electrode strips 8, 14 of the metal paste can be concurrently sintered in integral with the insulator 2, it is possible to facilitate the mass production of the spark plug 1.

Figure 5:
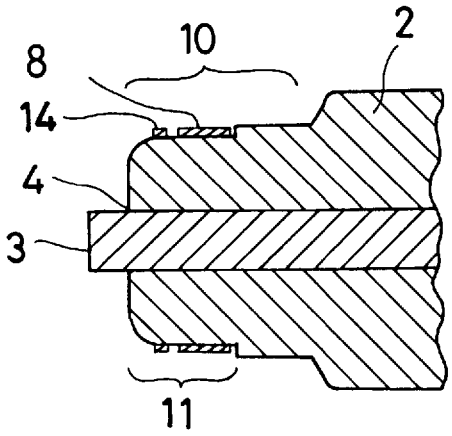
FIG. 5 is a longitudinal cross sectional view of a front portion of the insulator according to another embodiment of the invention.
Figure 6:
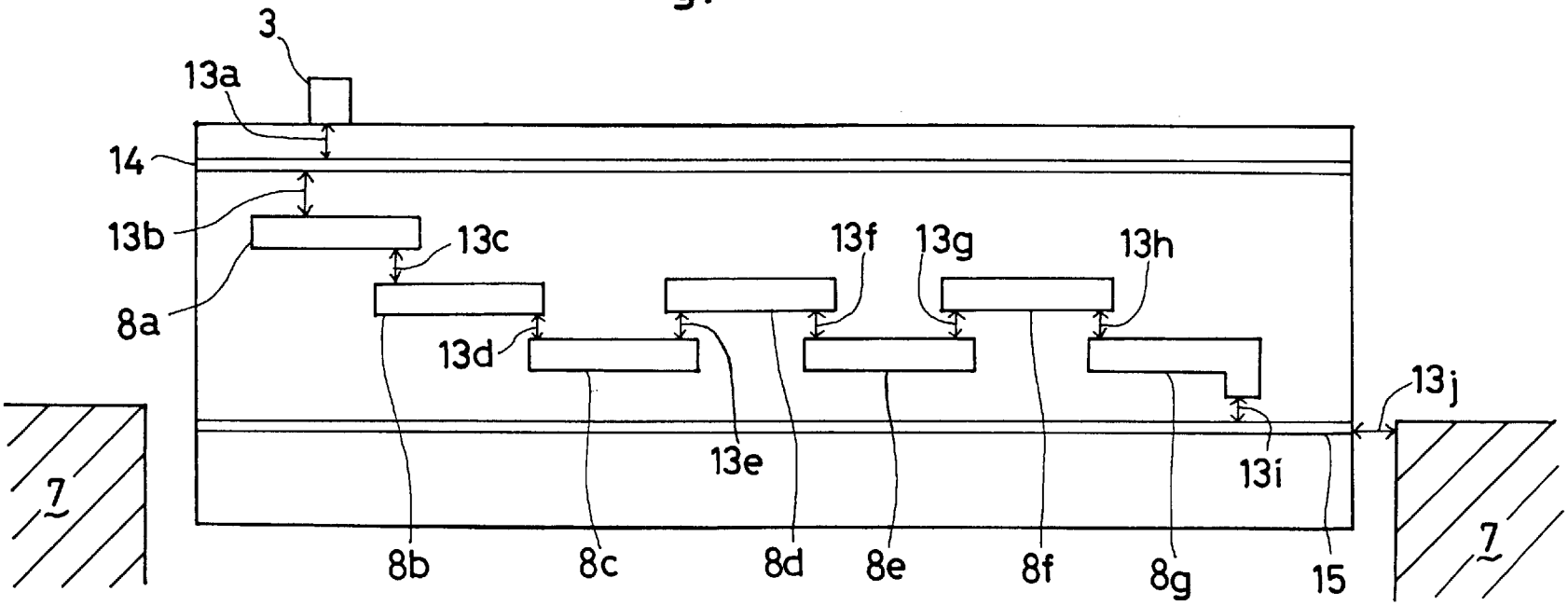
FIG. 6 is a view similar to FIG. 3 according to still another embodiment of the invention.

FIG. 5 shows a second embodiment of the invention in which a step portion 11 is provided on the surface of the leg or rather nose portion 10. On the surface of the step portion 11 of the leg portion 10, the electrode strips 8, 14 are placed. This makes it possible to exactly position the electrode strips 8, 14 when they are placed in such a method as explained with reference to FIG. 2. The auxiliary electrode strips 14 may be placed between the intermediary electrode strip 8 and the ground electrode 7 as shown in FIG. 6, and/or between the intermediary electrode strip 8 and the center electrode 3. When the insulator 2 is eccentrically displaced away from the center axis of the metal shell 6, this arrangement is effective because when the auxiliary electrode strip 14 is provided between the center electrode 3 and the intermediary electrode strip 8.

Figure 7:
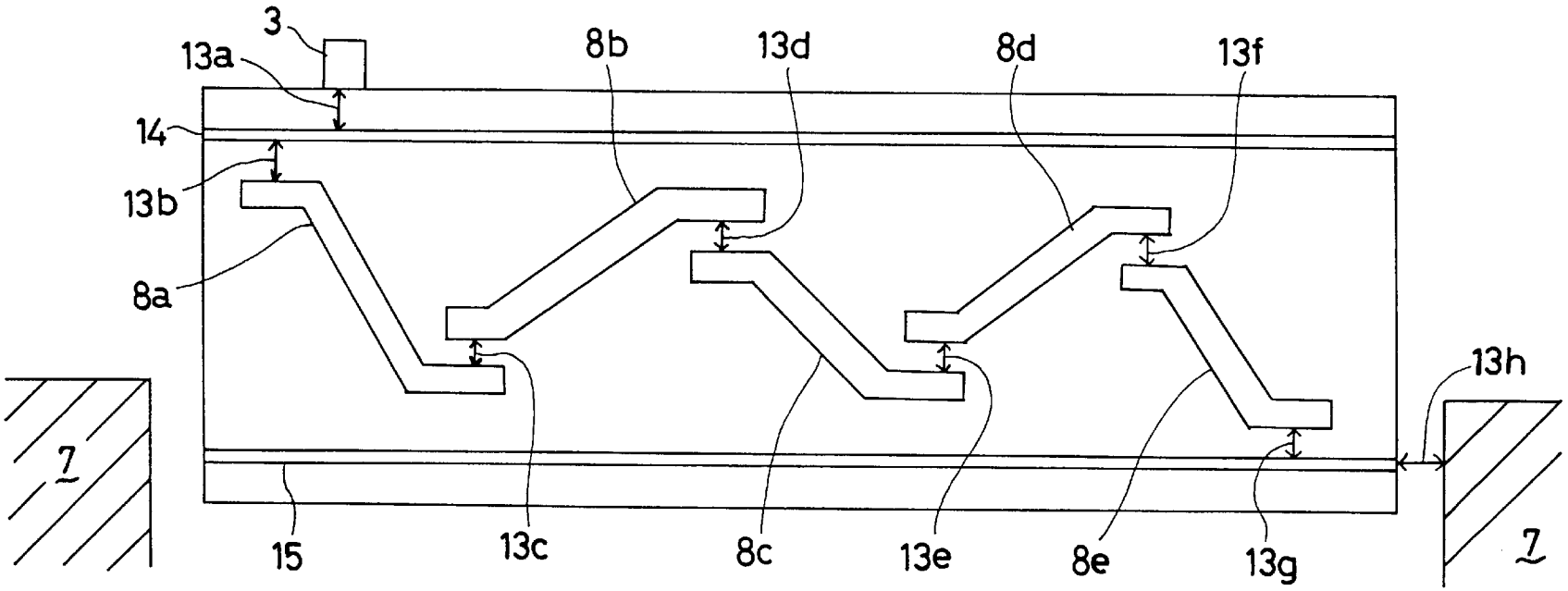
FIG. 7 is a view similar to FIG. 3 according to other embodiment of the invention.

FIG. 6 also shows a third embodiment of the invention in which the intermediary electrode strips 8*a*–8*g* are formed into a bar-shaped configuration instead of the sigmoidal configuration. The row of the intermediary electrode strips may be staggered to form a zig zag path as denoted by 8*a*–8*e* as shown in a fourth embodiment of the invention in FIG. 7, wherein the spark gaps 13*a*–13*j* are formed respectively between the center electrode 3 and the auxiliary electrode strip 14, between the intermediary electrode strip 8 and the auxiliary electrode strip 14, between the first–seventh intermediary electrode strips 8*a*–8*g*, between the intermediary electrode strip 8 and a second auxiliary electrode strip 15, and between the second auxiliary electrode strip 15 and the ground electrode 7. The second auxiliary electrode strip 15 is provided between the intermediary electrode strip 8 and the ground electrode 7 on the surface of the insulator.

With a circumferential arrangement of the intermediary electrode strips 8*a*–8*g* and the auxiliary electrode strips 14, 15 baked on the leg portion 10 of the insulator 2, it is possible to grow the spark discharge circumferentially or omnidirectionally and to ignite the swirls coming from any direction, while insuring a withstand voltage of the insulator and protecting the insulator 2 from cracks due to thermal shock. This arrangement makes it possible to fully burn out the carbon deposit piled on the leg portion 10 and to ignite the air-fuel mixture injected into the combustion chamber of the internal combustion engine, without failure.

Figure 8A:
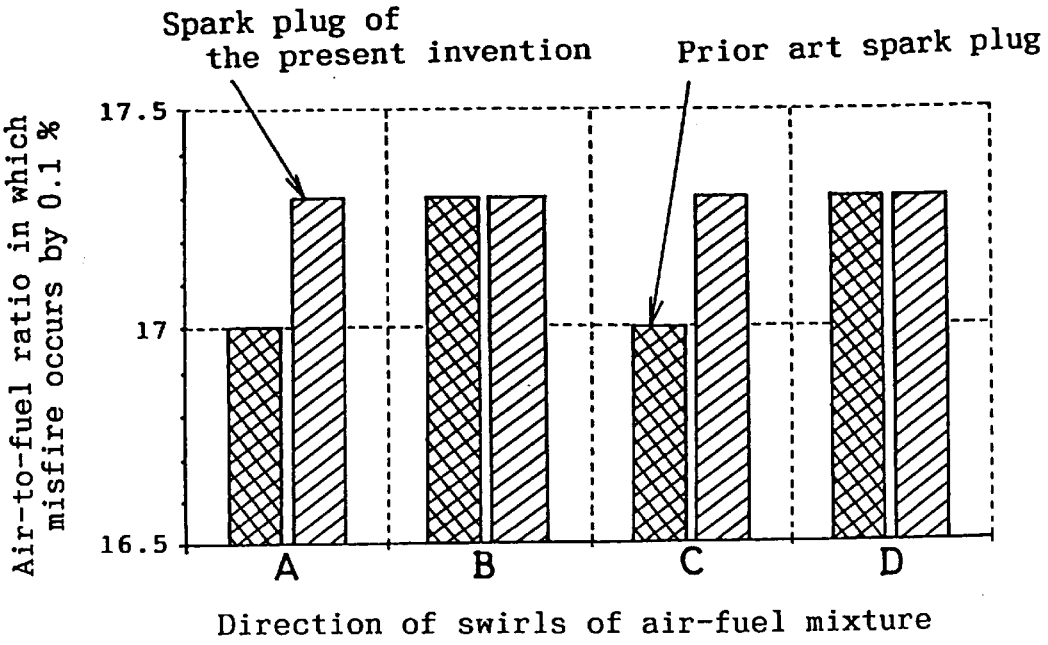
FIG. 8*a* is a graphical representation showing a comparison of an ignitability between the invented spark plug and the one having with a L-shaped ground electrode in the prior art.
Figure 8B:
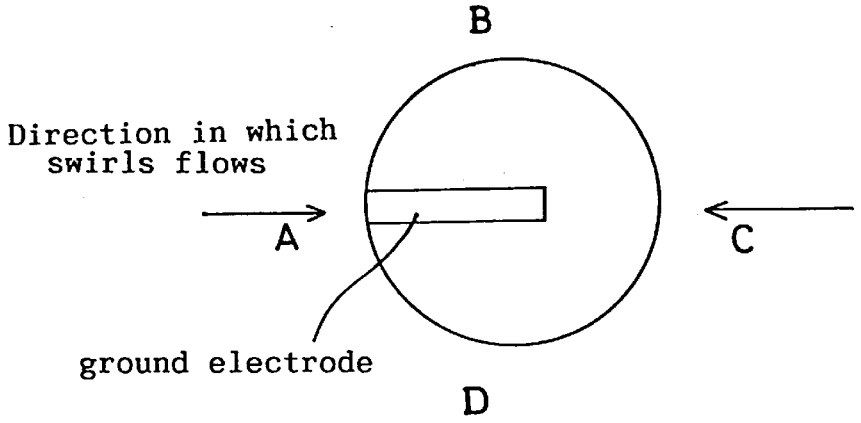
PRIOR ART Fig. 8b
FIG. 8*b* is a schematic view showing a direction in which an air-fuel mixture swirls against the wall of the insulator in a conventional spark plug.
Figure 9:
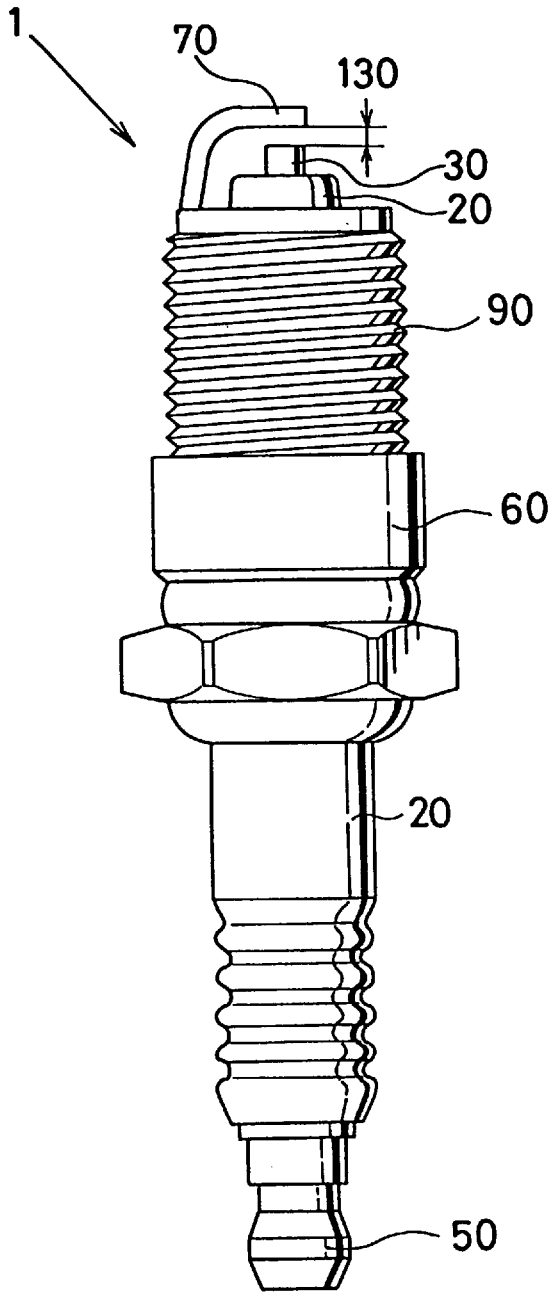
PRIOR ART Fig. 9
FIG. 9 is a plan view of a prior art spark plug.

FIGS. 8*a* shows a comparison of an ignitability of spark plugs between the present invention and the prior art (spark plug with a L-shaped ground electrode). In the prior art, the ignitability lowers in the direction of arrow A in which swirls come behind the ground electrode. The ignitability also goes down in the direction of arrow B in which the ignited flares encounter the ground electrode. On the contrary, it is possible to equally insure a good ignitability omnidirectionally in the case of the spark plugs of the invention.

As understood from the foregoing description, it is possible to omnidirectionally or circumferentially grow the spark discharges along the spark gaps between the center electrode and the annular ground electrode integral with the metal shell via the intermediary electrode strip and the auxiliary electrode strip arranged in a limited space by providing the intermediary electrode strip and the auxiliary electrode strip circumferentially around the leg portion of the insulator. With the spark discharges omnidirectionally grown, it is possible to satisfactorily burn out the carbon deposit piled on the leg portion of the insulator.

By adhering the intermediary electrode strip and the auxiliary electrode strip directly to the leg portion or the step portion of the insulator, and simultaneously sintering the intermediary electrode strip and the auxiliary electrode strip integrally with the insulator, it is possible to facilitate the mass production.

It is noted that the number of the intermediary electrode strips is not limited to five to seven but can be altered as needed.

While the invention has been described with reference to the specific embodiments, it is understood that this description is not to be construed in a limiting sense in as much as various modifications and additions to the specific embodiments may be made by skilled artisans without departing from the scope of the invention.

What is claimed is:

1. A spark plug comprising:

(1) a metal shell having first and second open ends;

(2) a ground electrode integral with said metal shell, provided on the first open end of said metal shell;

(3) an insulator having an axial bore, held in said metal shell;

(4) a center electrode in the bore of said insulator having a front end extending beyond said insulator; and (5) at least one row of intermediary electrode strips arranged intermittently in a circumferential direction around an end portion of said insulator so as to form a series of spark discharge gaps circumferentially around said end portion of said insulator, and disposed between said ground electrode and said end portion of said center electrode, wherein said at least one row of intermediary electrode strips is intermittently and circumferentially arranged in a staggered row around the end portion of the insulator, so that said at least one row of intermediary electrode strips varies in distance from said center electrode.

2. A spark plug as recited in claim 1, wherein a first auxiliary electrode strip is provided on said end portion of said insulator so as to be located between said center electrode and said at least one row of intermediary electrode strips.

3. A spark plug as recited in claim 2, wherein a second auxiliary electrode strip is provided on said end portion of said insulator, so as to be located between said ground electrode and said at least one row of intermediary electrode strips.

4. A spark plug as recited in any one of claims 2 and 3, wherein said at least one row of intermediary electrode strips is made of platinum or tungsten.

5. A spark plug as recited in any one of claims 2 and 3, wherein said at least one row of intermediary electrode strips is made of alumina-based ceramic material with platinum or tungsten.

6. A spark plug as recited in any one of claims 1, 2 and 3, wherein at least one of said first and said second auxiliary electrode strips is made of at least one of platinum-based and tungsten-based alloy.

7. A spark plug as recited in claim 3, wherein at least one of said first and said second auxiliary electrode strips is made of alumina-based ceramic material with platinum or tungsten.

8. A spark plug as recited in claim 3, wherein said end portion of said insulator has a narrow nose portion to which said at least one row of intermediary electrode strips, and said first and second auxiliary electrode strips are adhered.

9. A spark plug, comprising:

(1) a metal shell having first and second open ends;

(2) a ground electrode integral with said metal shell, provided on the first open end of said metal shell;

(3) an insulator having an axial bore, held in said metal shell;

(4) a center electrode in the bore of said insulator having a front end extending beyond said insulator; and (5) at least one row of intermediary electrode strips arranged intermittently in a circumferential direction around an end portion of said insulator so as to form a series of spark discharge gaps circumferentially around said end portion of said insulator, and disposed between said around electrode and said end portion of said center electrode, wherein a first auxiliary electrode strip is provided on said end portion of said insulator so as to be located between said center electrode and said at least one row of intermediary electrode strips, and wherein said at least one row of intermediary electrode strips has width-increased ends facing each other.

10. A spark plug comprising:

a metal shell having first and second open ends;

a ground electrode integral with said metal shell, provided on the first open end of said metal shell;

an insulator having an axial bore, held in said metal shell;

a center electrode in the bore of said insulator having a front end extending beyond said insulator;

at least one row of intermediary electrode strips arranged intermittently in a circumferential direction around an end portion of said insulator so as to form a series of spark discharge gaps circumferentially around said end portion of said insulator, and disposed between the said ground electrode and said end portion of said center electrode; and a first auxiliary electrode strip provided on said end portion of said insulator so as to be located between said center electrode and said at least one row of intermediary electrode strips, wherein said at least one row of intermediary electrode strips is intermittently and circumferentially arranged in a staggered row around the portion of the insulator, so that said at least one row of intermediary electrode strips varies in distance from said center electrode.

11. A spark plug as recited in claim 10, wherein said at least one row of intermediary electrode strips is made of platinum or tungsten.

12. A spark plug as recited in claim 10, wherein said at least one row of intermediary electrode strips is made of alumina-based ceramic material with platinum or tungsten.

13. A spark plug as recited in claim 10, wherein at least one of said first and said second auxiliary electrode strips is made of at least one of platinum-based and tungsten-based alloy.

14. A spark plug as recited in claim 10, wherein said at least one row of intermediary electrode strips has width-increased ends facing each other.

15. A spark plug comprising:

a metal shell having first and second open ends;

a ground electrode integral with said metal shell, provided on the first open end of said metal shell;

an insulator having an axial bore, held in said metal shell;

a center electrode in the bore of said insulator having a front end extending beyond said insulator;

at least one row of intermediary electrode strips arranged intermittently in a circumferential direction around an end portion of said insulator in a staggered row so as to form a series of spark discharge gaps circumferentially around said end portion of said insulator and so that said at least one row of intermediary electrode strip varies in distance from said center electrode, and disposed between the said ground electrode and said end portion of said center electrode;

a first auxiliary electrode strip provided on said end portion of said insulator so as to be located between said center electrode and said at least one row of intermediary electrode strips;

a second auxiliary electrode strip provided on said end portion of said insulator, so as to be located between said ground electrode and said at least one row of intermediary electrode strips, wherein:

said at least one row intermediary electrode strips has width-increased ends facing each other; and said end portion of said insulator has a narrowed nose portion to which said at least one row of intermediary electrode strips and said first and second auxiliary strips are adhered.

16. A spark plug as recited in claim 15, wherein said at least one row of intermediary electrode strips is made of platinum or tungsten.

17. A spark plug as recited in claim 15, wherein said at least one row of intermediary electrode strips is made of alumina-based ceramic material with platinum or tungsten.

18. A spark plug as recited in claim 15, wherein at least one of said first and second auxiliary electrode strips is made of at least one of platinum-based and tungsten-based alloy.

19. A spark plug as recited in claim 15, wherein at least one of said first and second auxiliary electrode strips is made of alumina-based ceramic material with platinum or tungsten.

* * * * *